United States Patent [19]

Latham et al.

[11] 4,221,078

[45] Sep. 9, 1980

[54] SEALED GLOBULAR DISPLAY DEVICE

[76] Inventors: John F. Latham; Elaine L. Latham, both of 405 W. Franklin St., Baltimore, Md. 21201

[21] Appl. No.: 946,407

[22] Filed: Sep. 27, 1978

[51] Int. Cl.[2] ..... A01G 5/04; A47G 7/02

[52] U.S. Cl. ..... 47/41 R; 47/41.12

[58] Field of Search ..... 47/41, 41 R, 41.12; 428/13; 215/2, 227, 321, 354; 220/355

[56] References Cited

U.S. PATENT DOCUMENTS

| | | | |
|---|---|---|---|
| 2,155,811 | 4/1939 | Tredup | 47/41.13 |
| 2,174,771 | 10/1939 | Bender | 47/41.12 |
| 2,226,950 | 12/1940 | Simpson | 47/41.13 |
| 2,601,658 | 6/1952 | Bussert | 47/41.12 |
| 2,717,728 | 9/1955 | Gray | 215/354 X |
| 3,164,279 | 1/1965 | Towns | 215/227 |
| 3,816,224 | 6/1974 | Smart et al. | 47/41.12 |
| 3,867,789 | 2/1975 | Jacobson | 47/41.12 |

FOREIGN PATENT DOCUMENTS

| | | | |
|---|---|---|---|
| 1483963 | 5/1967 | France | 215/227 |
| 1489084 | 6/1967 | France | 215/227 |
| 507483 | 6/1939 | United Kingdom | 47/41.13 |

*Primary Examiner*—Edgar S. Burr
*Assistant Examiner*—Steven A. Bratlie
*Attorney, Agent, or Firm*—Samuel Lebowitz

[57] ABSTRACT

A flexible rubber disk serving as a base for a transparent globular display container adapted to be filled with liquid, and as an effective seal for a circular opening in the latter bounded by a flared lip. The upper face of the base is provided with a central socket for a cylindrical block of yieldable porous plastic material in which are seated the components of a natural or artificial floral arrangement, or any other desirable ornament. The block is secured against displacement by arcuate ribs at the edge of the socket which impale substantially the entire lateral wall of the block. An annular recess in the upper face of the base permits the insertion thereinto of said flared lip at said circular opening, to form a liquid seal at the base of the annular slot and at the convexity of the flared lip against the inner lateral wall of the central portion of the disk delineated by the annular slot. Diametral slots in said central portion extending between the annular slot and socket afford passages between the interior and exterior of the container and a fine control of the seal adjacent the outer ends of the diametral slots. A slight flexing of the disk at these outer points breaks the seal sufficiently to expel air and/or water from the container, or to add water thereinto, if necessary, at the outer edge of the annular slot. The seal is re-established immediately upon the release of the flexing, - all this being done without disturbing the retention of the display in the socket of the base.

3 Claims, 3 Drawing Figures

SEALED GLOBULAR DISPLAY DEVICE

This invention relates to a decorative device comprised of a transparent globular display container for liquid, having a circular opening at the bottom which is sealed with a detachable base, and on which is supported an ornamental display which is immersed in the liquid in the container.

It is the object of the present invention to provide a detachable base for a globular display container which reliably seals the container against leakage of liquid therefrom, and which is readily manipulatable to attain a complete filling of the container with liquid while easily eliminating therefrom any air bubbles which may be trapped in the course of inserting the display into the filled container.

It is a further object of the invention to facilitate the filling and sealing of the container with liquid to make possible the use of fresh floral displays requiring relatively frequent changes of water.

Floral display globes filled with water in order to obtain the magnifying, beautifying and preserving effects upon the flowers, have been known for many years. U.S. Pat. No. 2,174,771, Oct. 3, 1939, is illustrative of such arrangements.

Many proposals have been made for assuring the seal between the globe and the base and to provide convenient and reliable support for the floral display to maintain the same in its properly centered position. It is the aim of this invention to simplify the maintenance of the seal between the globe and the base, while permitting a finely controlled degree of communication between a limited area of the base and globe to correspondingly control the discharge and entry of air or water. This is attained by the provision of diametral slots in the upper surface of the base which communicate with an annular retaining slot therein which affords the sealing action, so that a slight flexing of the base adjacent to its periphery eliminates the seal at these points for the passage of water or air thereat and which permits the restoration of the seal to be effected very quickly. This is done without loosening the hold of the block of retaining material at the center of the base so that the arrangement of the floral elements in the supporting block are in nowise affected by the manipulation of the seal at the periphery.

Other objects and purposes will appear from the detailed description of the invention following hereinafter, taken in conjunction with the accompanying drawing, wherein FIG. 1 is a vertical sectional view of the transparent globular display in accordance with the invention;

Figure 1:
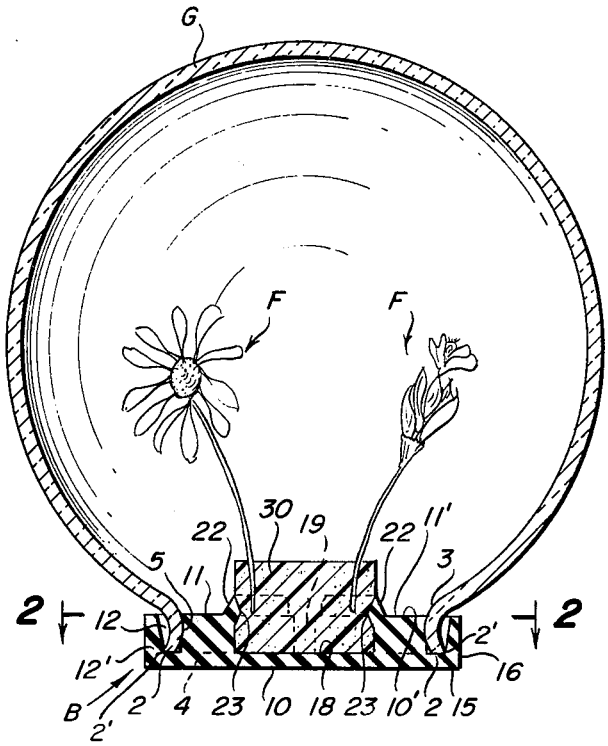

As shown in the drawing, the spherically-shaped globe G of glass or plastic is provided with a circular opening 4 at the bottom which is sealed with the base B of a special durometer rubber. The opening 4 at the base of the globe is defined by a flaring lip 3 which terminates at end 2 as it flares outwardly from an inner convexity 5 whereat the opening is of minimal diameter.

The base B is formed as a disk from a block of flexible rubber with a planar bottom supporting surface 10 and an upper surface 10' in which is cut an annular slot 12 spaced from the outer boundary 16 of the base. The slot 12 separates the central portion of the base B from the outer flange 12' and the former is provided with a socket 18 at its center for seating a cylindrical block of aqua-foam or other porous plastic material in which is adapted to be anchored the ornamental display components F. The cylindrical socket 18 is of substantial size, approximating one-half the diameter of the base, to accommodate either large or small foral displays.

Diametral slots 19 extend between the central socket 18 and annular slot 12 to facilitate the flexing of the base along the axis formed by these slots. This axis is indicated on the planar face 10 by arrows 21.

The plateaus 11 and 11' between the annular slot 12 and the socket 18, are provided with upstanding rims 22 which have a sharpened edge on the interior 23 which serve to impale the lateral wall of the porous block to enhance the retention thereof between the socket.

The principal seal between the globe and the base is made by the inner convexity 5 of the opening 4 when pressed adjacent to the lateral wall of the plateaus 11 and 11'. This seal is supplemented by the pressure of the bottom edge 2 of the globe against the base of the slot 12 which is supplemented by the penetration of the outer edge 2' into the corner junction 15 between the bottom of the base and the inner wall of the flange 12'. The penetration of the latter into the body of the base serves to direct the inner wall of flange 12' outwardly from contact with the globe to permit ready passage of air or water when the seal between the globe and base is relieved.

Figure 3:
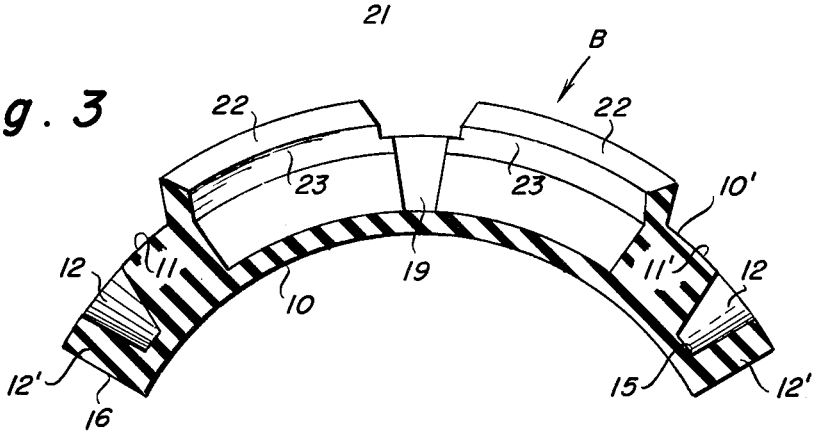
FIG. 3 is an exaggerated view of the base in flexed position when the seal between it and the globe is broken.

These sealing points described above, are sufficient to maintain the liquid within the container without leakage therefrom at the base. This seal can be easily vitiated by flexing the base very slightly, as indicated in exaggerated fashion in FIG. 3, which opens the passage between the outer ends of the diametral slots 19 and the base of the slot 12 for the introduction or elimination of water or the removal of air from within the globular container. The release of the flexing movement immediately reestablishes the seal between the interior and exterior of the assembly.

The manipulation of the base at the outer portions of the diametral slots 19 has no effect on the interior portions thereof adjacent to the lateral wall of the socket 18 which is reenforced by the rib 22 at the top thereof with the sharpened edge 23. Thereby, additional water, which the filling of the bowl requires, may be replenished and the trapped air may be released at the junctions of one of the outer ends of slot 19 with annular slot 12, without disturbing the central display seated within the socket 18.

Figure 2:
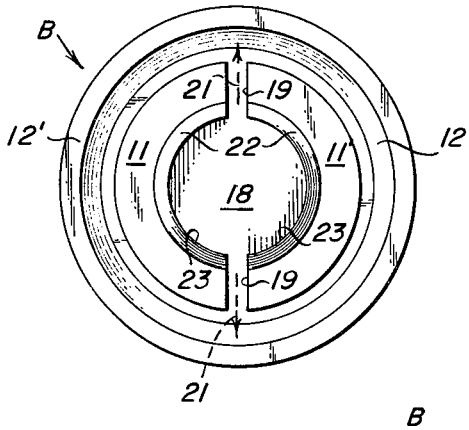
FIG. 2 is a horizontal sectional view along line 2—2 of FIG. 1.

The disposition of the slots 19 in the interior of the base is indicated on the bottom surface 10 by arrows 21 which are pointed in diametrically opposed directions, (FIG. 2).

It is understood that the need for manipulation of the base as described above is minimal, since the container is completely filled with water, with the opening disposed on the top, before the seal is applied thereto in up-side-down position, at which time the sealing is attained by inserting the flared lip within the slot 12 to effect the sealing with the outer walls of plateaus 11 and 11' and the body of the base at the bottom of the slot 12.

If any air has been trapped within the components of the floral arrangement these will come to the surface after the assembly stands for about one hour and can be forced therefrom by turning the globe bottom-up and by slightly tilting the same with either arrow 21 pointing in the outward direction. The seal can be broken at that point by a slight flexing, and a downward pressing at the center of the base effects the expulsion of any excess air and water. A remaining small air bubble is not objectionable, since the same will accommodate expansion and contraction caused by temperature changes.

The rubber base for a globular container of approximately eight inches in diameter may have a diameter of four inches and a thickness of three-fourths inch. The socket 18 for the block 30 of polyethylene foam may have a depth of a half inch, and a diameter of about two inches to seat the block 30 therein. The latter may have a thickness of about one inch and corresponding diameter of two inches, the lateral wall of which is pressed from opposite sides by the sharpened ribs 23. These dimensions may be varied as long as the parts operate mechanically as generally described above.

We claim:

1. In combination with a transparent globular display container for liquid having a circular opening at the bottom defined by an annular flaring lip, (a) a fluid-tight sealing base for said opening comprising an integral disk of resilient material having a bottom supporting surface and an annular slot defined by spaced parallel cylindrical walls in the upper surface inwardly from the outer margin of said disk to form an outer annular flexible flange surrounding the periphery of said lip at said opening and spaced therefrom, (b) a member at said upper surface defined by the inner cylindrical wall of said slot, said member being in fluid-tight sealing engagement along a substantial depth of said last-mentioned wall with the internal wall of said container at said opening, while said disk at the bottom of said slot is in fluid-tight sealing engagement with the outer extremity of said lip, (c) said member having a recessed cylindrical socket at the center thereof, of substantial surface area of about half of that of the base, (d) a cylindrical block of porous yieldable material for supporting a display within said container seated detachably within said socket, (e) said member having opposed diametral rectangular slotted fluid passages bisecting said member between said slot and cylindrical socket to facilitate limited flexing of said annular flange in lateral directions to control finely the passage of air and/or liquid between the interior and exterior of said container, and (f) an integral arcuate retaining projection extending inwardly from the top of each of the bisected portions of said member at the top of said socket, with each projection having an edge of reduced area for impaling the lateral surface of said block of porous material to enhance the retention therof within said socket.

2. A device as set forth in claim 1, wherein said cylindrical socket at the center of said member is of substantially the same depth as said annular slot.

3. A device as set forth in claim 2, wherein said block of porous yieldable material is of polyethylene foam.

* * * * *